United States Patent [19]

Ritter et al.

[11] 4,286,559

[45] Sep. 1, 1981

[54] PNEUMATIC DIAPHRAGM CONTROL MEMBER FOR A FUEL INJECTION DEVICE FOR INTERNAL COMBUSTION ENGINES

[75] Inventors: Ernst Ritter; Reinhard Schwartz; Rolf Müller; Martin Böhm, all of Stuttgart, Fed. Rep. of Germany

[73] Assignee: Robert Bosch GmbH, Stuttgart, Fed. Rep. of Germany

[21] Appl. No.: 56,665

[22] Filed: Jul. 11, 1979

[30] Foreign Application Priority Data

Aug. 31, 1978 [DE] Fed. Rep. of Germany ..... 2837964

[51] Int. Cl.[3] ..... F04B 49/00

[52] U.S. Cl. ..... 123/383; 123/391; 123/380

[58] Field of Search ..... 123/383, 391, 380, 382

[56] References Cited

U.S. PATENT DOCUMENTS

| | | | |
|---|---|---|---|
| 3,077,873 | 2/1963 | Parks | 123/383 |
| 3,986,487 | 10/1976 | Yanai | 123/382 |
| 4,057,044 | 11/1977 | Reich | 123/382 |
| 4,068,642 | 1/1978 | Little | 123/382 |
| 4,149,507 | 4/1979 | Little | 123/383 |

*Primary Examiner*—Charles J. Myhre
*Assistant Examiner*—Carl Stuart Miller
*Attorney, Agent, or Firm*—Edwin E. Greigg

[57] ABSTRACT

A pneumatic diaphragm control member is proposed for a fuel injection device for internal combustion engines, especially for a boost-pressure dependent full-load stop, wherein the initial and end positions of a push rod provided with a control diaphragm and movable against a resetting spring can be varied, and wherein the effective pressure range is variable by means of separate adjusting means which do not affect one another. The push rod of the diaphragm control member contacts, in the unpressurized starting position, a stop screw mounted in the lid cover, and, in the pressurized end position, is in contact, by means of a counter stop attached to an extension of the push rod and adjustable in the direction of motion of the push rod, with a second end stop arranged in the pressure chamber. Thus, the bias of the resetting spring can be changed by changing the position of a bearing bushing for the push rod, which bushing serves as an abutment.

4 Claims, 2 Drawing Figures

PNEUMATIC DIAPHRAGM CONTROL MEMBER FOR A FUEL INJECTION DEVICE FOR INTERNAL COMBUSTION ENGINES

BACKGROUND OF THE INVENTION

The invention is based on a pneumatic diaphragm control as described herein and finally claimed. Diaphragm control members of this type of construction, used in boost-pressure dependent full-load stops, are known, for example, from U.S. Pat. No. 4,057,044 and from the publication by Robert Bosch GmbH, Stuttgart, Federal Republic of Germany, "Diesel Injection Installation Speed Governors for Series-Type Injection Pumps", VDT-UBT 210/1 dated Sept. 30, 1975, p. 41, FIG. 91, and a diaphragm control member of a similar construction has been known from the publication by Robert Bosch GmbH, "Diesel Injection Installation" VDT-UBP 001/15 dated Apr. 30, 1973, p. 16, FIG. 20, wherein the starting and end positions of the push rod, as well as the bias of the resetting spring, can be adjusted by separate adjusting members to determine the beginning and end as well as the pressure range of the boost-pressure dependent correction of the full-load quantity. However, these devices have the disadvantage that, in the event of a subsequent correction of the starting position, which is frequently necessary to effect the adaptation of the full-load quantity without boost pressure, that is, the intake quantity, there is also a change in the end position of the push rod and consequently in the full-load quantity under full boost pressure, that is, the so-called boost quantity, or the effective pressure range. As a result, these values must be readjusted after changing the intake quantity adjustment.

OBJECT AND SUMMARY OF THE INVENTION

The diaphragm control member of this invention as claimed herein has, in contrast to the above, the advantage that all three settings for the intake and boost quantities, as well as for the pressure range can be set and readjusted independently of one another by control members separately arranged at the diaphragm control member. Since this diaphragm control member contains all of the control members, it can be utilized as a standard control member under a great variety of different mounting conditions, for example for attachment to a full-load stop that is dependent on the boost pressure and effective directly on the push rod. Moreover, the control member can likewise be utilized for a stop which engages the governor linkage and is mounted on the housing thereof. Any additional transmission elements for the control movement need not contain any adjusting elements or stops, whereby the construction of the full-load stops is considerably simplified.

By the measures recited in the dependent claims, advantageous further developments and improvements of the diaphragm control member indicated are made possible. Thus, by means of the new features, an easy accessibility of the second end stop is insured, and, due to the fact that an end face of a control disk mounted in the partition is utilized as the stop surface, a wearproof stop which limits the end position of the push rod is obtained, independently of the choice of material for the cover. The new features insure a ready accessibility to the adjusting nut that serves as the counter stop for the second end stop. In case of a cover plate sealed with a lead seal, it is no longer possible to adjust, in an unauthorized fashion, the set end position of the push rod (boost quantity), whereas the starting position (intake quantity) can be subsequently adjusted as desired by the engine manufacturer, without varying the other set values.

The invention will be better understood as well as further objects and advantages thereof become more apparent from the ensuing detailed description of preferred embodiments taken in conjunction with the drawings.

DESCRIPTION OF THE EMBODIMENTS

Figure 1:
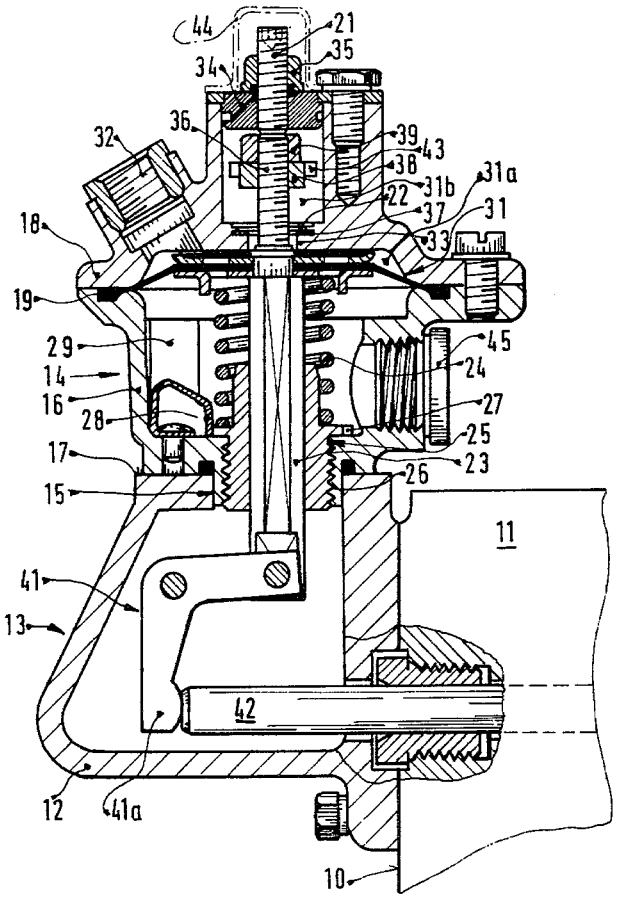
FIG. 1 shows generally in cross section a longitudinal view through the first embodiment of a boost-pressure dependent full-load stop provided with the diaphragm control member of this invention and mounted to the pump input or drive side of the injection pump.

Turning now to the drawings, in FIG. 1, the housing 12 of a boost-pressure dependent full-load stop 13 is flanged to an input-side end face 10 of a fuel injection pump 11. This housing 12 is provided with a pneumatic diaphragm control member 14. The control member 14 is attached by means of a centering flange 15 of its housing 16 to an end face 17 of the housing 12 and contains a control diaphragm 19 clamped between the housing 16 and a cover 18. The control diaphragm 19 is connected to a push rod 23 movable between two end stops 21 and 22. This push rod is guided in a bearing bushing 25 which serves simultaneously as an adjustable abutment for a resetting spring 24 and is threadedly inserted in the stop housing 16. The bearing bushing 25 is threaded into the housing 16 by means of a threaded area 26, is vertically adjustable and is secured in the respective position by a resilient tongue 28 which is arranged to engage in one of a number of detents denoted 27.

By means of the control diaphragm 19, the interior of the diaphragm control member 14 is subdivided into an atmospheric chamber 29 and a pressure chamber 31 surrounded by the cover 18. In this manner the pressure chamber is supplied with the boost air pressure ambient in the intake manifold of the engine via a connecting bore 32. The pressure chamber 31 within the cover 18 is subdivided by a partition 33 into two sectional chambers **31*a* and 31*b*. The first sectional chamber 31*a* is bounded by the control diaphragm 19, and the second sectional chamber 31*b* is sealed pressure-tight by a seal member 34, through which the first end stop, formed as a stop screw 21, is threaded and secured in the adjusted position by a counter nut 35**.

In the illustrated, unpressurized condition of the stop, an extension 36 which projects upwardly from the push rod 23, contacts this stop screw 21. The second end stop 22, which determines the operating position of the push rod 23 assumed under maximum boost pressure, is constituted by the end face of a steel disk 37, which serves as the stop surface as shown in the drawings. The end stop 22 limits the stroke of a counter stop 38 that is attached to the extension 36 of the push rod 23. The counter stop 38 comprises an adjusting nut, as shown, which is threaded onto the extension 36 of the push rod 23, which extension is fashioned as a threaded pin.

In the illustrated position, the adjusting nut 38 is secured by a counter nut 39. The steel disc 37, manufactured from tempered spring steel, is secured in the intermediate wall 33 by means of annular caulking and thus, in the case of a cover 18 produced (for reasons of cost and weight) from aluminum, forms a wear-resistant second terminal stop for the push rod 23 by means of the end face 22. Further, the push rod 23 transmits its adjustment motion through a bell crank 41 which is pivotably supported in the housing 12 of the full-load stop 13 and into a control rod 42 which acts as the supply quantity adjustment member of the injection pump 11. The end 41*a* of the bell crank 41 represents the full-load stop which is adjustable in accordance with charge pressure.

The adjusting nut 38, which serves as the counter stop, has engagement or contact surfaces 43 along a rim enlarged with respect to the outer diameter of the counter nut 39 and to this area a tool may be attached to achieve adjustments. Such a tool can consist, in a compact structure, of two nestled, tubular socket wrenches and can be introduced, after removing the sealing plate 34, into the second sectional chamber 31*b* and placed over the nuts 38 and 39. The counter stop 38 which cooperates with the second end stop 22 determines the position assumed by the full-load stop 41*a* under full boost pressure. This point, limiting the maximum power, must no longer be adjusted in an unauthorized fashion, and the sealing plate 34 is, therefore, provided with a lead seal after setting the adjusting nut 38. As can be seen clearly from FIG. 1, it is then still possible to adjust the stop screw 21, which serves as the first end stop, from the outside to correct the starting position and the position of the full-load stop 41*a* thus determining the intake quantity. If this setting of the stop screw 21 is also to be secured against unauthorized manipulation, then it is possible to attach a sealing cap, indicated in dot-dash lines and denoted by 44, over this screw at the end face of the sealing plate 34.

After removal of a lateral sealing screw 45 in the housing 16 in the area beneath the diaphragm control member 14, the bias of the resetting spring 24 can be varied by rotating the bearing bushing 25, whereby the pressure range and thus also the speed range can be shifted. It is to be understood that it is in this range that the boost-pressure dependent correction of the full-load injection quantity takes place. Accordingly, all points determining the characteristic of the boost-pressure dependent correction can be set separately from one another and without exerting any mutual influence.

Figure 2:
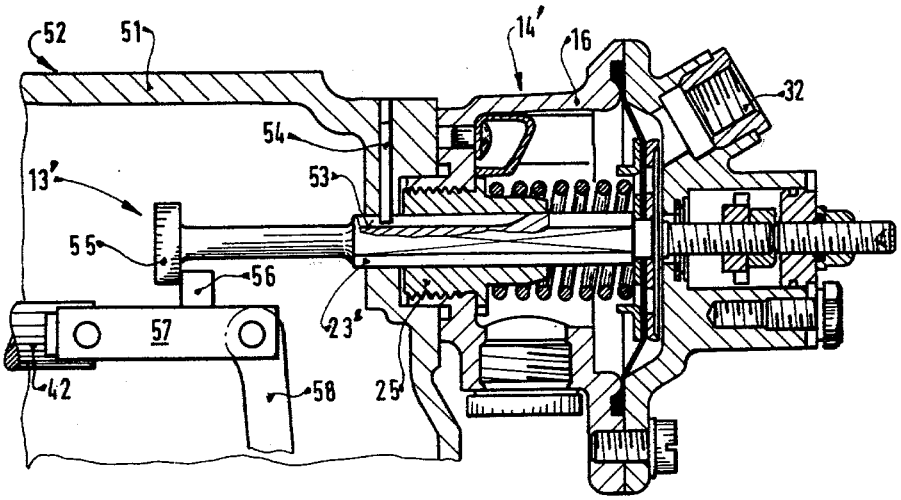
FIG. 2 shows another cross sectional view through a boost-pressure dependent full-load stop engaging into a speed governor.

In the second embodiment shown in FIG. 2, the boost-pressure dependent full-load stop, here denoted by 13', is flanged to a governor housing 51 of a centrifugal speed governor 52 and consists essentially of a diaphragm control member 14' arranged in the horizontal position as contrasted to the diaphragm control member 14 in FIG. 1.

This diaphragm control member 14' is flanged with its housing 16 directly to the governor housing 51, without inter-position of an additional abutment housing and merely differs from the diaphragm control member 14 of the first embodiment in that it has a modified form of the push rod 23'. This push rod 23' is guided in the bearing bushing 25, and secured against twisting or rotation by means of a pin 54 which engages into a longitudinal slot 53 provided in the governor housing 51 as shown. The push rod 23' carries, at its end which projects into the governor housing 51, a head-like full-load stop 55 that limits the stroke of a stop lug 56. This stop lug 56 extends out of a connecting fishplate 57, which latter connects a regulating lever 58 of the centrifugal speed governor 52 with the control rod 42 Thus, the stroke of the control rod 42 is limited indirectly by limiting the stroke of the connecting fishplate 57. This stroke is limited, in the illustrated, unpressurized position of the push rod 23', to the full-load position which determines the intake quantity, and with a full boost pressure being supplied by way of the connecting bore 32 and with a full-load stop 55 correspondingly shifted toward the left as viewed in the drawing, this stroke is limited to the full-load quantity which determines the boost quantity. Except for the changed shape of the push rod 23', all other elements of the diaphragm control member 14' are identical to those of the diaphragm control member 14 in FIG. 1 and thus will not be described anew.

If there is insufficient space in the longitudinal direction of the speed governor 52 to attach the boost-pressure dependent full-load stop to this particular speed governor, it is also possible to attach, on the governor side, a full-load stop equipped with a vertically disposed diaphragm control member 14, constructed similarly to the stop in FIG. 1, which acts via an angle lever on the stop lug 56 of the connecting fishplate 57. The stop lug 56 can, of course, also be connected directly with the control rod 42, so that the structural configuration of the governor components has no influence on the boost-pressure dependent limitation of the full-load quantity. To avoid excessive stress on the full-load stop and an overloading of the governor elements, a resiliently yielding drag or buffer member is to be inserted in a manner which is known and thus is not illustrated in detail, at some location of the governor linkage in the power train between the governor sleeve and the full-load stop.

What is claimed and desired to be secured by Letters Patent of the United States is:

1. An adjustable pneumatic diaphragm control member for a fuel injection device for an internal combustion engine comprising:

a housing for connection with a fuel injection pump;

a control member connected with said housing;

a cover secured to said control member;

a control diaphragm clamped between said control member and said cover thereby separating the area within said cover from the area within said control member;

an axially adjustable bushing secured in said control member on the side thereof which is connected to said housing;

a push rod coaxially secured to said control diaphragm at one end and extending through said adjustable bushing into said housing;

a resetting spring coaxially with said push rod and said bushing and situated between a shoulder on said bushing and said control diaphragm for forcing said diaphragm upwardly; said resetting spring being adjustable by rotation of said bushing in said control member;

a push rod extension secured to one end of said push rod in axial alignment with said push rod and extending from said control diaphragm into said cover, an axially adjustable stop member adjustably secured in said cover in axial alignment with said push rod extension which coacts with said push rod extension for adjustment of the upward movement of said diaphragm, an adjustable counter-stop means coaxially secured on said push rod extension and adjustable axially along said push rod extension, an end stop means rigidly mounted in said cover adjacent to said control diaphragm, said end stop means coacting with said adjustable counter stop to stop the downward movement of said diaphragm against said resetting spring when said counter stop contacts said end stop spring, inlet means in said cover for admitting pneumatic pressure into said cover above said control diaphragm, and a means secured in said housing with one end relative to said push rod for operating a control rod of an injection pump in accordance with pneumatic pressure admitted through said inlet means above said control diaphragm.

2. A pneumatic diaphragm control member according to claim 1, further wherein said end stop means which is rigidly mounted relative to said cover comprises an apertured steel disk.

3. A pneumatic diaphragm control member according to claim 1, further wherein said counter stop includes a radially extending rim area to accommodate an adjustment tool and said axially disposed extension of said push rod further includes a locking nut for cooperation with said adjustable counter stop.

4. A pneumatic diaphragm control member according to claim 1, 2 or 3, further wherein said adjustable stop member further includes a threaded element which is adjustable relative to a sealing plate positioned in said cover and a lock nut for said threaded element.

* * * * *